United States Patent [19]

Flanders et al.

[11] 4,381,573

[45] May 3, 1983

[54] SHOE UPPER CONFORMING MACHINE

[75] Inventors: James R. Flanders, Blaby; David W. Halford, Birstall; John F. Carr, Sileby, all of England

[73] Assignee: USM Corporation, Farmington, Conn.

[21] Appl. No.: 279,882

[22] Filed: Jul. 2, 1981

[30] Foreign Application Priority Data

Jul. 2, 1980 [GB] United Kingdom ..... 8021731

[51] Int. Cl.[3] ..... A43D 21/00

[52] U.S. Cl. ..... 12/12; 12/8.2

[58] Field of Search ..... 12/8.1, 8.2, 12, 14.3, 12/14.4

[56] References Cited

U.S. PATENT DOCUMENTS

| | | | |
|---|---|---|---|
| 2,082,841 | 6/1937 | Mackensen | 12/12 |
| 2,878,497 | 3/1959 | Chambers | 12/8.2 |
| 3,685,072 | 8/1972 | Schindler et al. | 12/12 |

*Primary Examiner*—Patrick D. Lawson

*Attorney, Agent, or Firm*—Donald N. Halgren

[57] ABSTRACT

In a side (or heel seat and side) lasting machine, opposite side portions of the upper are clamped against the last, by means of clamp pads arranged in two rows one at each side of the last, prior to the lasting margin being wiped over corresponding marginal portions of the insole. To ensure that the upper lies snugly against the last prior to the in-wiping operation, the most heel-wardly disposed pad of each row is so mounted that, as it is moved inwardly towards the last, it engages the upper at a position spaced from the feather line thereof, continued inward movement thereafter causing the pad to move towards the feather line, thereby causing an upward drafting of the upper. Said pads may be mounted to pivot or to be deflected to effect such upward draft. If desired, adjacent pads may be similarly mounted.

14 Claims, 2 Drawing Figures

SHOE UPPER CONFORMING MACHINE

BACKGROUND OF THE INVENTION (1) Field of the Invention

This invention is concerned with shoe upper conforming machines, more especially shoe upper conforming machines for use in the lasting of side portions of shoes, or shoe upper conforming machines for use in the lasting of heel seat and side portions of shoes. The word "shoe" where used herein is used generically as indicating outer footwear generally, and as including articles of outer footwear in the course of their manufacture.

(2) Prior Art

Shoe upper conforming machines for use in lasting side portions of shoes are known comprising a last support for supporting a shoe last on which a shoe upper and insole are positioned, clamping means, comprising two pad members disposed one at each side of the last support and arranged to engage a shoe upper at opposite sides thereof and to clamp it against its last supported by the last support, drive means for moving said pad members towards the last support to engage and clamp the upper as aforesaid, and two side lasting assembles arranged so as to act on opposite side portions of the upper clamped as aforesaid to wipe marginal portions of said upper over and press them against corresponding marginal portions of the insole. One such machine, the clamping means of which comprises a row of pad members arranged side-by-side, is described in the specification of our U.S. application Ser. No. 134,459.

In the machine described in said specification, furthermore, the side lasting assemblies each comprise a plurality of wiping elements, in the form of fingers, the arrangement being such that the clamp pad members and their associated wiping fingers, which are arranged above the clamp pad members, are moved together by the drive means towards the last support, the arrangement being such that when the clamping means has engaged and clamped the upper against its last, the movement of the wiping fingers continues to wipe the lasting marginal portions of the upper over and press them against corresponding marginal portions of the insole. While this arrangement of clamp pad members and wiping fingers is satisfactory for a large proportion of shoes manufactured, nevertheless the situation may arise where it is difficult with this construction and arrangement to cause the material of the upper to lie snugly against the last especially in the shank region; this arises for example with shoes in which the side of the last is cut away steeply in that region and is usually associated with shoes the insole of which has a narrow shank portion in relation to the remainder thereof. Thus, in operating on such shoes, it is often found that after lasting the sides of the shoe in the shank region have excess material, giving rise to a "baggy" appearance.

In machines similar to the aforementioned machine it has been proposed to provide so-called breast line grippers by which the lasting marginal portions of the upper can be gripped in the region of the breast line thereof (or at the heelward end of the side lasting assemblies), for the purpose of drawing the excess material heightwise of the last prior to the clamping and lasting of the shoe as aforesaid. Using breast line grippers, however, gives rise to the problem of feeding the lasting marginal portions into the open grippers, which is time-consuming, and also the provision of the breast line grippers and actuating means therefor significantly increases the total cost of the machine.

It is therefore the object of the present invention to provide a shoe upper conforming machine for use in lasting side portions of shoes in the operation of which the aforementioned problem of excess material especially in the shank region can be mitigated without significantly increasing the overall cost of the machine, and also without requiring an extra operation on the part of the operator.

BRIEF SUMMARY OF THE INVENTION

The invention provides a shoe upper conforming machine for use in lasting side portions of shoes comprising a last support for supporting a shoe last on which a shoe upper and an insole are positioned, clamping means, comprising two pad members disposed one at each side of the last support and arranged to engage a shoe upper at opposite sides thereof and to clamp it against its last supported by the last support, drive means for moving said pad members towards the last support to engage and clamp an upper as aforesaid, and two side lasting assemblies arranged so as to act on opposite side portions of the upper clamped as aforesaid to wipe marginal portions of said upper over and press them against corresponding marginal portions of the insole, wherein the pad members are arranged to engage the upper as aforesaid each at a position spaced from the feather line of the shoe under the action of the drive means, the pad members being mounted in such a manner that continued operation of the drive means after the engagement of the pad members with the upper is effective to urge the pad members heightwise of the last towards said feather line, so that any excess material in the upper is urged towards the lasting margin thereof and the upper is thus caused to lie snugly about its last prior to the operation of the side lasting assemblies.

It will thus be appreciated that the pad members achieve an effect which is generally similar to that achieved by the use of breast line grippers, but without the need for the operator to "feed" the material of the upper, and without any expensive separate actuating means for causing the pad members to operate to achieve the effect.

The pad members may each comprise a blade-like member mounted on a support block of deformable material and inclined towards the feather line of the upper to be lasted, said blade-like member being arranged to engage the upper as aforesaid and the support block being operatively connected to the drive means, the arrangement being such that continued operation of the drive means after the engagement of the blade-like member with the upper is effective to deflect said member heightwise of the last towards said feather line, the support block being deformed to allow such deflection to take place.

Alternatively, instead of mounting each pad member on a support of deformable material, each pad member may be mounted for pivotable movement about an axis extending lengthwise of a shoe to be lasted and be urged by resilient means towards the shoe, away from the feather line thereof, when in a rest condition, the arrangement being such that continued operation of the drive means after engagement of the pad members with the upper is effective to cause each such member to be pivoted against the action of the resilient means and thus to be urged heightwise of the last towards the feather line of the upper. Preferably, each pad member is pivotally mounted on a support therefor, each support being operatively connected to the drive means.

Where the pad members are pivotally mounted, it may be desirable to determine the position of each pad member when in a rest condition in order to control the position at which the pad members engage the upper as aforesaid. For example, it may be that a pattern feature of the upper will require engagement by the pad members more closely to the feather line than would otherwise be required. To this end, therefore, the machine in accordance with the invention is preferably provided with adjustable stop means for determining the position of each pad member when in a rest condition.

Furthermore, whichever arrangement of pad members is used, it will be desirable to ensure that such members do not project beyond the level of the work-engaging surfaces of wiper members of the machine during the in-wiping movement of the latter, and to this end the machine preferably comprises limit means whereby each pad member is prevented from being urged heightwise as aforesaid beyond the feather line of the shoe. Thus, where the pad member comprises a blade-like member mounted on a support block of deformable material, preferably the support block is carried by a rigid support operatively connected to the drive means therefor and the stop means is constituted, for each pad member, by a rigid limit plate carried by or integral with said rigid support. Where, on the other hand, the pad members are pivotally mounted as aforesaid, then preferably, for each pad member, the stop means comprises an abutment member secured to the pad member and movable therewith, as the pad member is caused to be pivoted on its support, into engagement with the support for said pad member.

It will be apparent that on the one hand the pad members, in order to apply any drafting force to the upper material, must be capable of gripping the material sufficiently to effect such drafting force while on the other hand scuffing of the upper material must be avoided and at the same time the wear properties of the material of the pad members must be such that no significant deposit thereof be left on the upper material after drafting force has been applied. Furthermore, it will also be apparent that the optimum requirements for the material of the pad members will vary according to the material of the shoe upper. Conveniently, in the machine in accordance with the invention, each pad member is of a material, e.g. a polyurethane elastomer, having a Durometer hardness in the range 60 to 80, preferably 70, and having a coefficient of friction (measured using a dry steel inclined plane at room temperature) in the range 1.05 to 1.20, preferably 1.13.

The clamping means of the machine in accordance with the invention may comprise two rows of pad members disposed one at each side of the last support and arranged to engage a shoe upper at each side of the last support and to clamp it against its last supported by the last support. In such a case, the most heelwardly disposed pad member of each row may be mounted for movement heightwise of the last in the manner aforesaid. Preferably, however, at least the two most heelwardly disposed pad members of each row are so mounted, so that the drafting force is applied to side portions of the upper will be over a larger area.

The invention is also applicable to shoe upper conforming machines for use in lasting heel seat and side portions of shoes, such machines comprising in addition to the foregoing a heel band and heel seat wiper members, wherein the wiper members together with wiping elements of the side lasting assemblies form a substantially continuous wiping surface. In such a machine, each pad member (or, where two rows of pad members are provided as aforesaid, the most heelwardly disposed pad member of each row) is arranged one adjacent each toeward end portion of the heel band so that, when the heel seat wiper members are moved into operative position and lasting marginal portions of the upper are thus caused to be wiped over and pressed thereby against corresponding marginal portions of the insole, toeward portions of said wiper members move over said pad members.

Furthermore, where the clamping means of the machine comprises two rows of pad members disposed as aforesaid, the most heelwardly disposed pad member of each row is preferably mounted on a frame portion on which the heel band and heel seat wiper members are supported, while the other pad members of each row are mounted for bodily pivotal movement, together with the side lasting assemblies, about an axis extending transversely of the bottom of a last supported by the last support. Furthermore, said transverse axis preferably extends through toeward end portions of the heel seat wiper members, when in operative position, and in the plane of the work-engaging surface of said members. Thus, where the pad member or members next to the most heelwardly disposed pad member of each roll are also mounted for movement heightwise of the last in the manner aforesaid, they are also capable of pivoting bodily together with the side lasting assemblies. In this way, the side lasting assemblies can be oriented according to the shoe bottom contour, without detracting from the provision of pad members which are capable of applying a drafting force to the upper during the clamping of the upper by the pad members.

BRIEF DESCRIPTION OF THE DRAWINGS

There now follows a detailed description, to be read with reference to the accompanying drawings, of one machine in accordance with the invention. It will of course be appreciated that this machine to be described has been selected for description merely by way of exemplification of the invention and not be way of limitation thereof.

In the accompanying drawings.

DESCRIPTION OF THE PREFERRED EMBODIMENT

Figure 1:
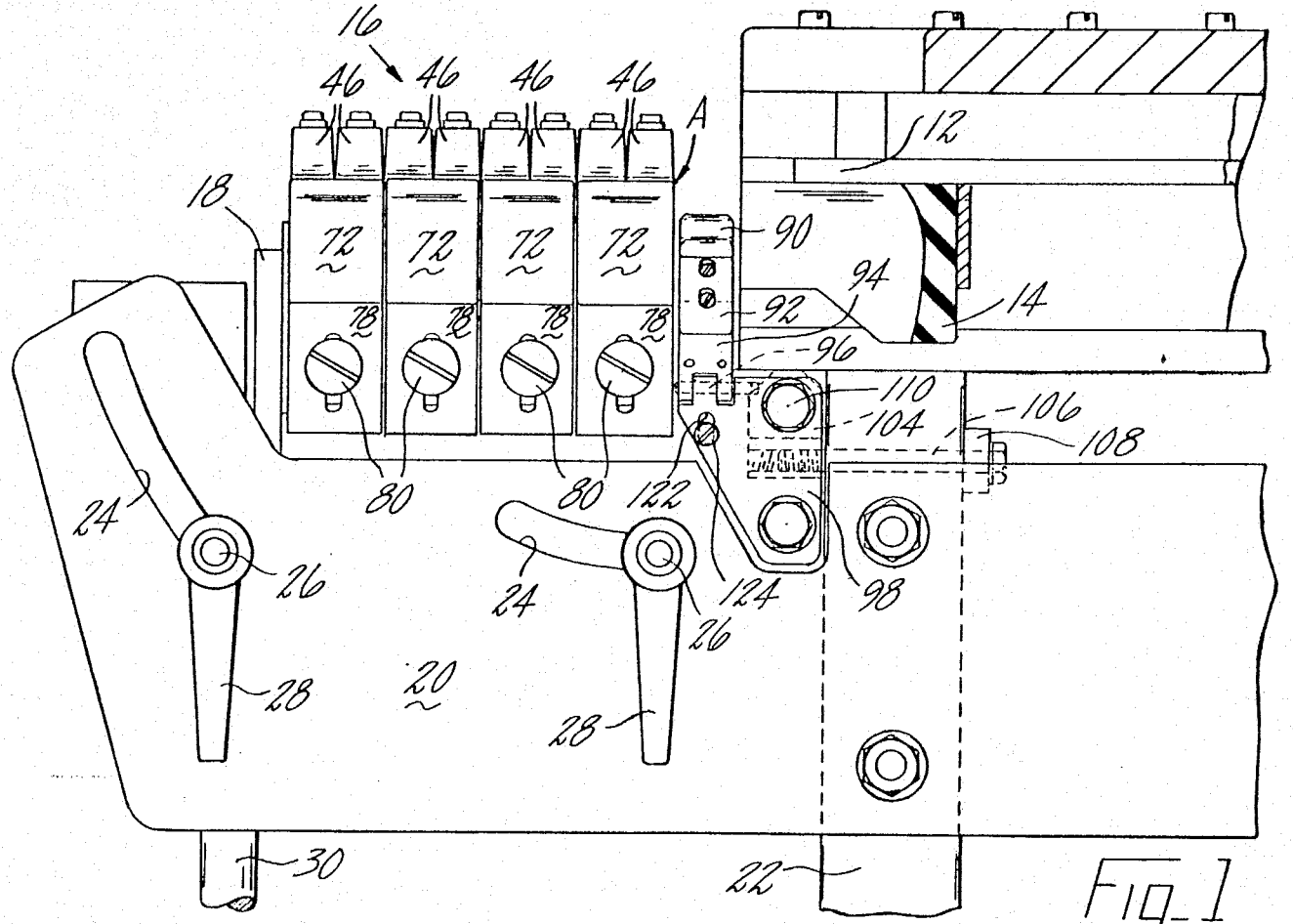
FIG. 1 is a fragmentary side view along a center line of the machine, showing details of the clamping means thereof.

The machine now to be described is a shoe upper conforming machine for lasting heel seat and side portions of shoes and is generally similar, except as hereinafter described, to the machine described in the aforementioned specification. Thus, the machine now to be described comprises a last support (not shown) of generally conventional type on which a last can be supported, bottom uppermost, with an insole located on the bottom thereof and a shoe upper positioned thereon. The machine further comprises heel seat wiping instrumentalities, including heel seat wipers 12 (again of conventional construction) and a heel band 14, and also two side lasting assemblies generally designated 16, arranged forwardly of the heel seat lasting instrumentalities, one at either side of the last support. Each side lasting assembly 16 comprises a sub-frame 18 carried on a forwardly extending plate 20 secured to a portion of a main machine frame 22. The plate 20 has a pair of shaped slots 24 therein, arranged to receive a bolt 26 carried by the sub-frame 18, each bolt 26 being provided with a clamping handle 28 for locking the sub-frame 18 in adjusted position. The slots 24 are so arranged that the side lasting assembly 16 can pivot bodily about an axis A extending through the leasing edge of the heel seat wipers 12 when in an advanced operative condition, in which lasting marginal portions of the heel seat of the shoe upper are wiped over and pressed against corresponding marginal portions of the insole, the axis A also lying in the plane of the work-engaging surface of the wipers 12. For pivoting the sub-frame, when released by the handles 28, a handle 30 is provided on the front thereof.

Each side lasting assembly comprises a plurality of, viz. eight wiping elements 46, in the form of fingers arranged side-by-side, which serve to wipe the lasting margin of the upper over the insole and to secure it thereto. For effecting in-wiping movement of the wiping elements 46, furthermore, drive means, in the form of piston-and-cylinder arrangements (not shown) are provided, two elements being associated with each arrangement. Associated with each pair of wiping elements 46, furthermore, is a clamp pad member 72, there being four such pad members. The side lasting assembly 16 should be pivoted bodily as aforesaid so as to ensure that the pad members 72 engage the shoe in the feather line region thereof; that is to say, the side lasting assembly 16, including the wiping elements 46 together with the clamping means of which the pads 72 form part, should be pivoted bodily to accommodate the shoe bottom contour.

In the operation of the machine, each clamp member 72 is movable, in a direction extending tranversely of the shoe bottom, into and out of an operative position in which it engages with the shoe upper and clamps it against its last. To this end, each clamp member is mounted on a plate 78 carried on a push rod 80 supported at one end by the plate 20 and at the other by a bracket (not shown), the push rod 80 being connected to the piston-and-cylinder arrangement by which the wiping elements 46 associated with the pad member are also caused to move inwardly towards the last support. Thus, after engagement of the shoe by the clamp pad member, continued operation of said piston-and-cylinder arrangement is effective to cause the in-wiping movement of the elements 46 to continue, while the pressure applied to the shoe by the clamp member is enhanced.

In addition to the clamp pad members 72, the clamping means of the machine also comprises a pair of further pad members 90, one disposed at each side of the last support and arranged to engage a shoe upper at opposite sides thereof and to clamp it against its last supported by the last support, said two further pad members 90 being arranged adjacent the toeward end portions of the heel band 14 so that, when the heel seat wiper members 12 are moved into operative position as aforesaid, toeward portions of said members move over the pad members 90. (The wiping elements 46 and the heel seat wiper members 12 are so arranged, that, in the operative position of the wiper members 12, they form, together with the wiping elements 46, a continuous wiping surface. Furthermore, the pad members 72 and the pad members 90 are so arranged, in two rows disposed at opposite sides of the last support, that they provide, together with the heel band, a substantially continuously clamping surface around the whole of the area of the shoe to be lasted.)

Figure 2:
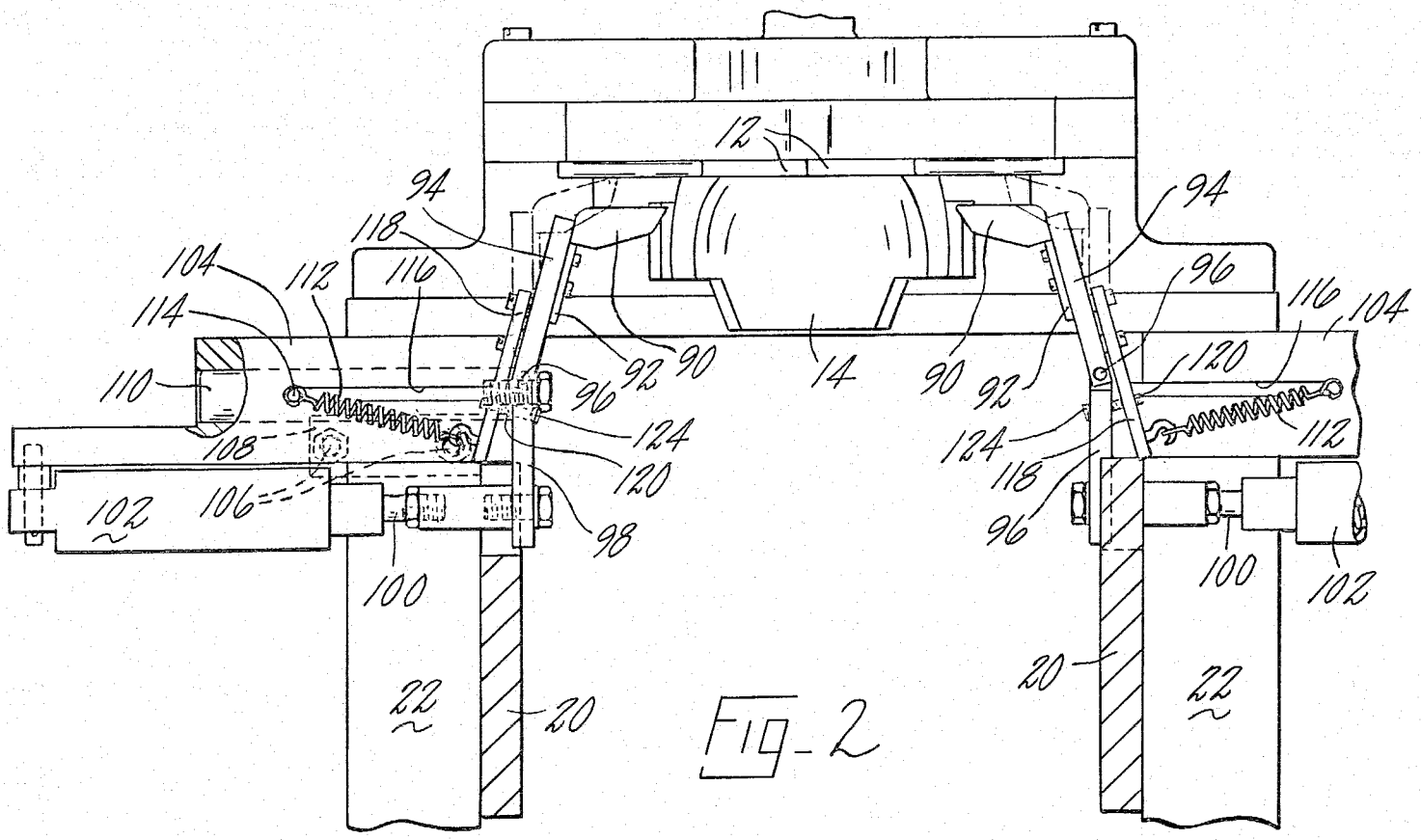
FIG. 2 is a section view taken along the line II—II of FIG. 1, showing details of the mounting of the most heelwardly disposed pad member of said clamping means.

Each pad member 90 is in the form of a blade-like member having an upwardly inclined work-engaging surface, as shown in FIG. 2, said member being moulded on to an L-shaped support 92, of relatively rigid metal, which serves to prevent upward deflection of the blade-like member 90. The metal support 92 is bolted to a carrier plate 94 which is supported for pivotal movement, through a pin 96, on a support 98. The support 98 is carried at a forward end of a piston rod 100 of a piston-and-cylinder arrangement 102 which is mounted on a block 104 secured, by means of a pair of clamping bolts 106 and a clamp plate 108, to the main frame portion 22. The block 104 accommodates a pin 110 which is screwed on to the support 98 to prevent rotation thereof. Thus, upon actuation of the piston-and-cylinder arrangement 102, the support 98, and thus the pad member 90, are each caused to move inwardly towards the last support. The pad member 90 is urged into a position, in which it will engage a shoe below the feather line thereof, about the pivot pin 96 by means of resilient means in the form of a spring 112 which acts between a pin 114, carried by the pin 110 and projecting through a slot 116 in the block 104, and an abutment member 118 which is bolted to the carrier plate 94. The extent to which the pad member 90 is so urged is determined by adjustable stop means in the form of a screw member 120 threadedly received in the abutment member 118 and passing through a slot 122 formed therefor in the support 98, the arrangement being that a head 124 of the adjustment member 120 engages with the support 98, thus to determine the position of the pad member 90. Furthermore, movement of the pad member from said position heightwise of the last is limited by limit means, constituted by abutment faces of the abutment member 118 and the support 98, the arrangement being such that abutment of said two abutment faces terminates the pivotal movement about the pin 96 of the pad member 90. In the machine described, such movement is terminated when the carrier plate 94 and the support 98 are moved into alignment with one another. In this way, the pad members are prevented from moving beyond the plane of the work-engaging surfaces of the wiper members 12, as they are moved towards the feather line of the shoe.

In the operation of the machine, with a shoe placed on the last support, the clamping means of the machine is first caused to move inwardly, under the action of the piston-and-cylinder arrangements (not shown) for the clamp pad members 72 and of the piston-and-cylinder arrangements 102, which operate the pad members 90. When the pad members 90 engage with the shoe, and such engagement will take place at a position spaced from the feather line of the shoe, continued operation of the piston-and-cylinder arrangements 102 will cause the pad member 90 to pivot about their pins 96, whereby the pad members are caused to move heightwise of the last towards the feather line of the shoe. In this way, any excess material in the upper in the region of engagement by the pad members 90 is urged towards the lasting margin thereof and the upper is thus caused to lie snugly about its last to the operation of the wiper members 12 and 46. When the abutment faces provided by the abutment member 118 and the support 98 are brought into engagement, the pad members 90 will have reached the feather line of the shoe, and further movement thereof heightwise of the last is prevented, while clamping pressure is maintained by the piston-and-cylinder arrangements 102. At the same time, the clamp pads 72 will be maintaining clamping pressure on the upper, and with the shoe so clamped, a lasting operation can then take place under the action of the lasting wiper members 12 and 46.

Figure 3:
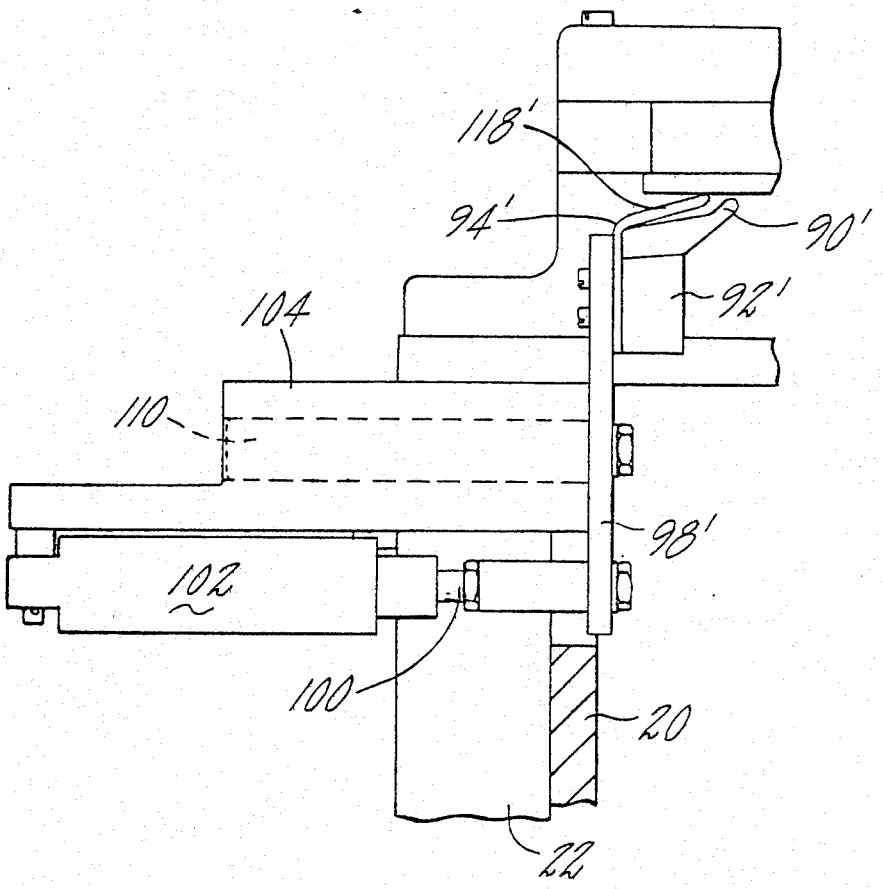
FIG. 3 is a fragmentary view of an alternative form for the most heelwardly disposed pad member of the clamping means.

In FIG. 3 is shown an alternative to the pad members 90. In this alternative form, the piston rod 100 of the piston-and-cylinder arrangement 102 carries a support 98' which extends heightwise to a distance equivalent to the support 98 and carrier plate 94 of the arrangement previously described, and terminates with an integral over-turned portion 118'. Bolted to an upper portion of the support 98' is a support plate 94' to which is secured, e.g. by adhesive, a block 92' of a spongy deformable material. To this block 92', furthermore, is secured, again e.g. by adhesive, a blade-like pad member 90', which is generally similar to the pad member 90. In the operation of the machine using the alternative form, actuation of the piston-and-cylinder arrangements 102 is effective to move the supports 98' inwardly until the pad members 90' engage with the upper, such engagement again taking place at a position spaced from the feather line of the shoe, the pad members 90' being appropriately mounted on their block 92' for this purpose. Continued actuation of each piston-and-cylinder arrangement 102 is then effective, bearing in mind that each blade-like member 90' has an upwardly inclined work-engaging surface, to cause the pad members 90' to be deflected heightwise of the last towards the feather line of the shoe, the support block 92' in each case being deformed to allow such deflection to take place. The overturned portion 118' of each support 98', furthermore, constitutes limit means whereby such deflection is terminated when the pad members 90' have reached the feather line of the shoe.

In a further alternative form (not shown), instead of each pad member 90 being mounted on a carrier plate 94 pivotally supported by the support 98, which support is carried by the piston rod 100 of the piston-and-cylinder arrangement 102, itself fixedly carried on the block 104, said piston-and-cylinder arrangement is itself pivotally mounted on the block and the carrier plate 94 and support 98 are replaced by a single support member carried by the piston rod, the block 104 being suitably cut away to accommodate such pivotal movement. The pivot point for such movement is arranged in a plane below the position of engagement between the pad member 90 and the shoe. Resilient means, in the form of a spring, is provided for urging the piston-and-cylinder arrangement about its pivot point in such a manner as to cause the pad member 90, when in its rest condition, to be urged towards the shoe and away from the feather line thereof, to a limit determined by adjustable stop means, and the pivotal movement of said arrangement to bring the pad member 90 towards the feather line as aforesaid is limited by suitable limit means. In operation of said further alternative form, as each pad member 90 is moved from its rest condition, it is first caused to engage the upper and press it against its last under the action of its piston-and-cylinder arrangement, continued operation of which, after such engagement, is effective to cause said arrangement to pivot, thus in turn causing the pad member to be urged towards the feather line of the shoe.

Whereas in the machine above described (whichever form of pad member 90, 90' is used), only the most heelwardly pad member of each row is arranged to be moved upwardly towards the feather line after it has engaged the upper as aforesaid, it will be appreciated that, if desired, the adjacent pad member or members in each row may be similarly mounted.

Whichever pad member is used, the pad members 90 (or 90') are each made of a material having a Durometer hardness in the range 60 to 80, preferably 70, and a co-efficient of friction (measured using a dry steel inclined plane at room temperature) in the range 1.05 to 1.20, preferably 1.13. One material which has been used in a polyurethane elastomer identified as "Hyperlast 70" and supplied by the McPherson Polymers (U.K.) division of McPherson Industrial Coating Limited, of Bury, Lancashire, England.

We claim:

1. A shoe upper conforming machine for use in lasting side portions of shoes comprising:

a last support for supporting a shoe last on which a shoe upper and an insole are positioned;

clamping means, comprising two pad members disposed one at each side of the last support and arranged to engage a shoe upper at opposite sides thereof and to clamp it against its last supported by the last support;

drive means for moving said pad members towards the last support to engage and clamp an upper as aforesaid; and a pair of side lasting assemblies arranged so as to act on opposite side portions of the upper clamped as aforesaid to wipe marginal portions of said upper over and press them against corresponding marginal portions of the insole, wherein the pad members are arranged to engage the upper as aforesaid each at a position spaced from the feather line of the shoe under the action of the drive means, the pad members being mounted in such a manner that continued operation of the drive means after the engagement of the pad members with the upper is effective to urge the pad members heightwise of the last towards said feather line, so that any excess material in the upper is urged towards the lasting margin thereof and the upper is thus caused to lie snugly about its last prior to the operation of the side lasting assemblies.

2. A shoe upper conforming machine as recited in claim 1 wherein each pad member comprises a blade-like member mounted on a support block of deformable material and inclined towards the feather line of the upper to be lasted, and wherein the blade-like member is arranged to engage the upper as aforesaid and the support block is operatively connected to the drive means, the arrangement being such that continued operation of the drive means after the engagement of the blade-like member with the upper is effective to deflect said member heightwise of the last towards said feather line, the support block being deformed to allow such deflection to take place.

3. A shoe upper conforming machine as recited in claim 1 wherein each pad member is mounted for pivotal movement about an axis extending lengthwise of a shoe to be lasted and is urged by resilient means towards the shoe, away from the feather line thereof, when in a rest condition, the arrangement being such that continued operation of the drive means after engagement of the pad members with the upper is effective to cause each such member to be pivoted against the action of the resilient means and thus to be urged heightwise of the last towards the feather line of the upper.

4. A shoe upper conforming machine as recited in claim 3 wherein each pad member is pivotally mounted on a support therefor, each support being operatively connected to the drive means.

5. A shoe upper conforming machine as recited in claim 3 wherein an adjustable stop means is provided for determining the position of each pad member when in a rest condition.

6. A shoe upper conforming machine as recited in claim 2 wherein a limit means is provided whereby each pad member is prevented from being urged heightwise as aforesaid beyond the feather line of the shoe.

7. A shoe upper conforming machine as recited in claim 6 wherein the support block of each pad member is carried by a rigid support operatively connected to the drive means therefor and the stop means is constituted, for each pad member, by a rigid limit plate carried by or integral with said support.

8. A shoe upper conforming machine as recited in claim 5 wherein, for each pad member, the stop means comprises an abutment member secured to the pad member and movable therewith, as the pad member is caused to be pivoted on its support, into engagement with the support for said pad member.

9. A shoe upper conforming machine as recited in claim 8 wherein each pad member is of a material having a Durometer hardness in the range 60 to 80, preferably 70, and having a co-efficient of friction (measured using a dry steel inclined plane at room temperature) in the range 1.05 to 1.20, preferably 1.13.

10. A shoe upper conforming machine as recited in claim 1 wherein the clamping means comprises two rows of pad members disposed one at each side of the last support and arranged to engage a shoe upper at each side of the last support and to clamp it against its last supported by the last support, and wherein at least the two most heelwardly disposed pad members of each row are mounted for movement heightwise of the last in the manner aforesaid.

11. A shoe upper conforming machine for use in lasting heel seat and side portions of shoe as recited in claim 7 also comprising a heel band and heel seat wiper members, said wiper members together with wiping elements of the side lasting assemblies forming a substantially continuous wiping surface, wherein the two pad members are arranged adjacent toeward end portions of the heel band so that, when the heel seat wiper members are moved into operative position and lasting marginal portions of the upper are thus caused to be wiped over and pressed thereby against corresponding marginal portions of the insole, toeward portions of said wiper members move over said pad member.

12. A shoe upper conforming machine for use in lasting heel seat and side portions of shoes as recited in claim 7 also comprising a heel band and heel seat wiper members, said wiper members together with wiping elements of the side lasting assemblies forming a substantially continuous wiping surface, wherein the most heelwardly disposed pad member of each row is arranged adjacent a toeward end portion of the heel band so that, when the heel seat wiper members are moved into operative position and lasting marginal portions of the upper are thus caused to be wiped over and pressed thereby against corresponding marginal portions of the insole, toeward portions of said wiper members moved over said pad members.

13. A shoe upper conforming machine as recited in claim 12 wherein the most heelwardly disposed pad member of each row is mounted on a frame portion on which the heel band and heel seat wiper members are supported, while the other pad members of each row are mounted for bodily pivotal movement, together with the side lasting assemblies about an axis extending transversely of the bottom of a last supported by the last support.

14. A shoe upper conforming machine as recited in claim 13 wherein said transverse axis extends through toeward end portions of the heel seat wiper members, when in operative position, and in the plane of the work-engaging surface of said members.

* * * * *